United States Patent [19]

Wagner

[11] Patent Number: 4,736,896

[45] Date of Patent: Apr. 12, 1988

[54] AUTOMATIC-FEED GRINDER AND MEAT GRINDING METHOD

[75] Inventor: Richard C. Wagner, Frankfort, Ill.

[73] Assignee: Hollymatic Corporation, Countryside, Ill.

[21] Appl. No.: 830,447

[22] Filed: Feb. 18, 1986

[51] Int. Cl.[4] ..... B02C 18/36

[52] U.S. Cl. ..... 241/82.6; 241/82.1

[58] Field of Search ..... 241/82.1–82.7, 241/186 A, 246, 247

[56] References Cited

U.S. PATENT DOCUMENTS

| | | | |
|---|---|---|---|
| 1,750,645 | 3/1930 | Offenhauser . | |
| 2,006,318 | 6/1935 | Schmidt | 146/182 |
| 2,459,951 | 1/1949 | Metzner | 202/176 |
| 2,636,284 | 4/1953 | Napier | 34/182 |
| 2,658,604 | 11/1953 | Erdmenger et al. | 198/64 |
| 3,219,081 | 11/1965 | Brundler | 146/182 |
| 3,310,086 | 3/1967 | Lasar | 146/186 |
| 3,450,180 | 6/1969 | Braun | 146/182 |
| 3,612,130 | 10/1971 | Ponka | 146/181 |
| 3,653,420 | 4/1972 | Viene | 146/186 |
| 3,825,231 | 7/1974 | McFarland | 259/41 |

*Primary Examiner*—Timothy V. Eley

*Attorney, Agent, or Firm*—Wood, Dalton, Phillips, Mason & Rowe

[57] ABSTRACT

An automatic-feed grinder for meat having a grinding head mounted on a frame and held in position thereon by clamping bars and a hopper superimposed thereon. The hopper and grinding head have generally similar front-to-rear dimensions providing a compact construction resulting from reverse flow of meat including rearward flow in the hopper provided by self-feeding counter-rotating augers which feed the meat through a bottom discharge opening adjacent the rear wall thereof into a top opening of a grinding head. The grinding head has a feed screw which advances the meat in the grinding head forwardly through grinding elements. The compact construction provided by the superimposed relation of the grinding head and hopper permits the simple drive of the counter-rotating augers and the feed screw by drive connections at the rear of the hopper and grinding head to drive means mounted on the frame. The hopper is mounted on the frame for compound movement including front-to-rear movement for either connecting or disconnecting the drive connections between the drive means and the counter-rotating augers as well as pivotal movement about an axis externally of the hopper to move the hopper to a distance away from the grinding head to permit removal of the latter from the frame. The hopper and the grinding head are held in position on the frame by clamping structure which can be operated without the use of special tools to facilitate assembly and disassembly of the grinder.

20 Claims, 4 Drawing Sheets

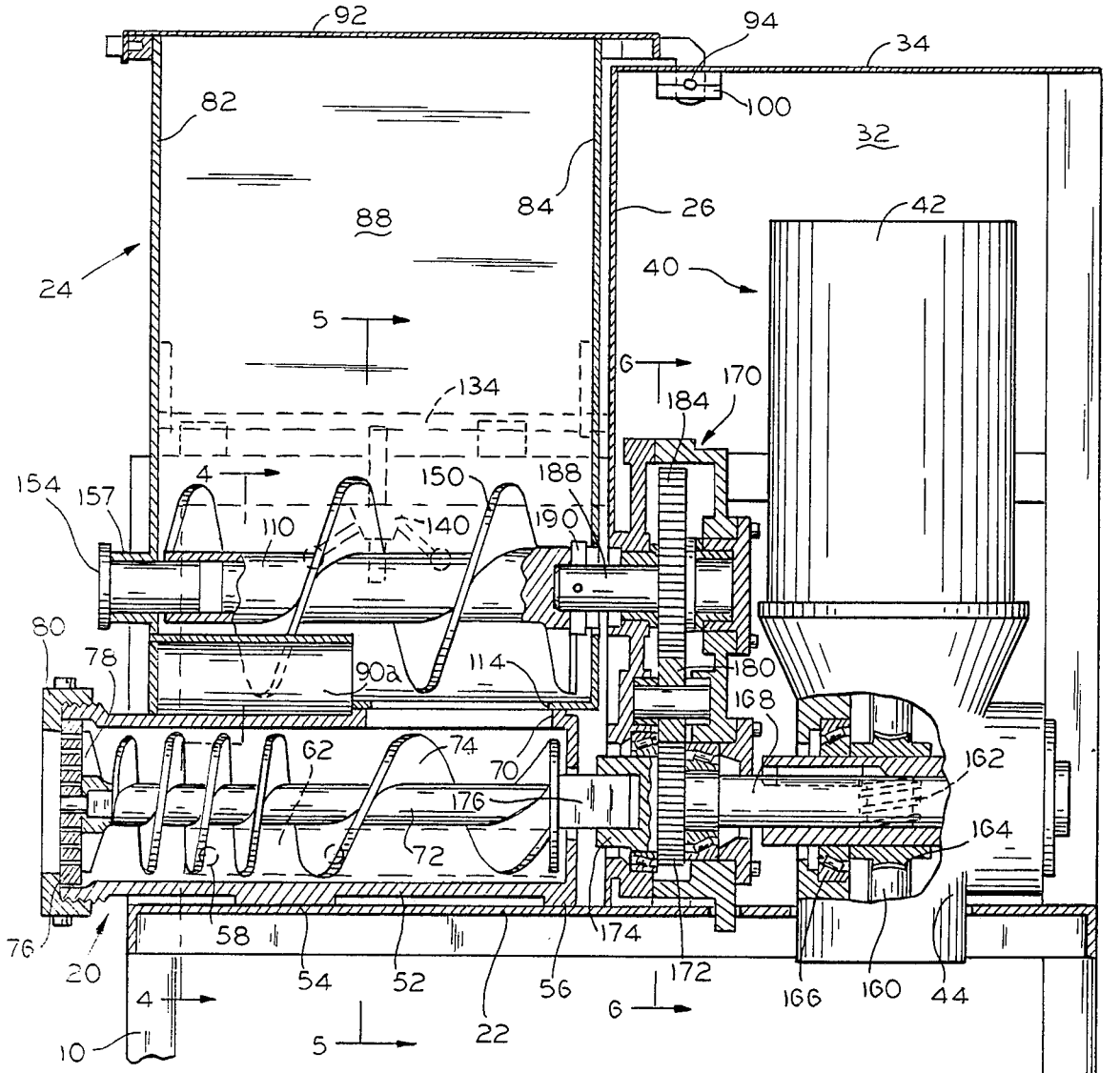
FIG. 3
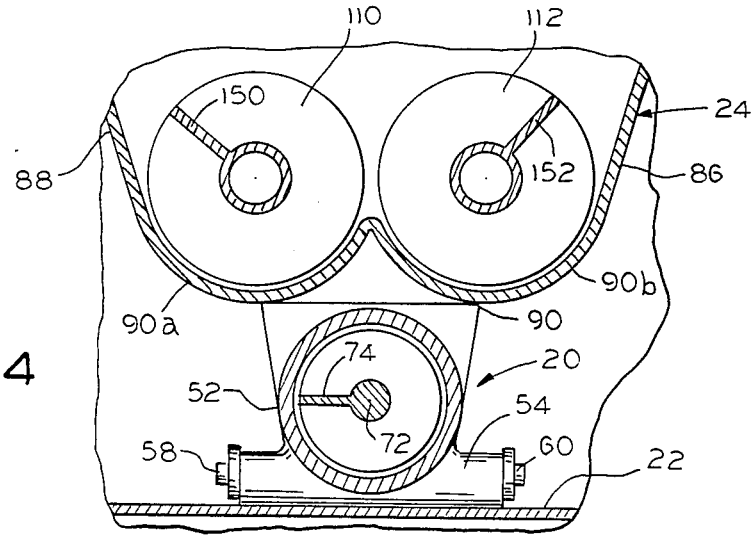
FIG. 4
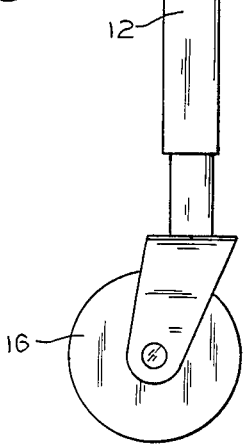

AUTOMATIC-FEED GRINDER AND MEAT GRINDING METHOD

BACKGROUND OF THE INVENTION

This invention pertains to an automatic-feed grinder which is compact and easy to clean by a disassembly of components without requiring the use of any special tools. A hopper has removable self-feeding augers which positively move tempered meat or large pieces of fresh meat to and through a grinding head. The hopper and grinding head are located forwardly of a drive gear box with the hopper located above the grinding head. The hopper can be moved forward relative to the drive gear box to release drive connections between the gear box and the augers and, thereafter, pivoted to a position to provide access to the grinding head whereby the components for feeding and grinding the meat can be cleaned easily.

Automatic-feed grinders are known in the art. One type of such grinder has an inverted conical hopper overlying a grinding head. This is a type of grinder construction used in butcher shops for many years wherein meat is manually pushed downwardly through the throat of the hopper into the grinding head having a feed screw for feeding the meat through grinding elements. This type of grinder is also known to have automatic feed wherein a generally vertically-extending auger within the hopper can advance the meat into the grinding head. This type of grinder is normally used in grinding small batches of meat.

Another form of automatic feed grinder has a hopper of substantial size for holding a large quantity of meat to be ground, with feeding means extending along the bottom of the hopper for moving the meat forwardly in the hopper to a discharge opening at the front end thereof and into a grinding head at a level lower than the hopper and extending forwardly from the front wall thereof. This type of automatic feed grinder requires substantial space because of the grinding head extending forwardly of the hopper and has other disadvantages in the complexity of the drive for the feeding means in the hopper and the feed screw in the grinding head as well as requiring a relatively complex disassembly for cleaning of the hopper and grinding head and components thereof which handle the meat.

The invention disclosed herein distinguishes over the prior art in relating to a compact, automatic-feed grinder requiring less space than previously-known devices having the same capacity and which has components readily disassembled without the use of special tools for cleaning thereof and a relatively simple drive mechanism for counter-rotating augers in the hopper and the feed screw of the grinding head because of the structural relation, one to the other. This structural relation is achieved by having the hopper and grinding head in superimposed relation with reverse flow of meat therein and all of the drive connections to the counter-rotating augers and the feed screw located at the rear of the hopper and grinding head and in generally vertical alignment.

SUMMARY OF THE INVENTION

A primary feature of the invention is to provide a new and improved automatic-feed grinder of a compact construction having a hopper of a substantial size superimposed on a grinding head. There is reverse flow of meat with the meat in the hopper being fed rearwardly thereof to the grinding head and the meat then being fed forwardly in the grinding head. A number of advantages result from the reverse flow of meat, including the compactness of the unit as well as the relatively simple drive required for the meat-feeding components in the hopper and the grinding head and the easy disassembly of the grinder for cleaning thereof without the use of any special tools.

More particularly, a grinding head is releasably held on a frame and a hopper having front to rear dimensions generally coextensive with those of the grinding head is mounted on the frame and rests upon the grinding head with a bottom outlet discharge opening in the hopper adjacent the rear wall thereof communicating with a top opening in the grinding head. A pair of counter-rotating augers extend along the bottom of the hopper and feed meat rearwardly of the hopper and to and through the discharge opening for movement into a cavity of the grinding head having a feed screw which advances the meat through grinding elements at the front end of the grinding head. The counter-rotating augers positively feed the meat into the grinding head and continually exert pressure on this meat, with this pressure, as well as that created by the feed screw in the grinding head, forcing the meat through the grinding elements. The counter-rotating augers are located above and extend parallel to the feed screw of the grinding head, with these augers and the feed screw having drive connections at the rear of the hopper and the grinding head to drive means mounted on the frame.

The automatic feed grinder can be disassembled by removal of the grinding elements and the feed screw from the grinding head and by removal of bearings in the front wall of the hopper which support one end of the counter-rotating augers. The hopper is mounted on the frame for forward movement a distance sufficient to enable release of the drive connections at the other end of the augers to the drive means and, particularly, to drive shafts extending through the rear wall of the hopper. Thereafter, the hopper may be pivoted about an axis outside the bodythereof provided by a pivot mounting of the hopper to the frame to lift the hopper away from the grinding head and to a tilted position to facilitate cleaning and which frees the grinding head for removal from the frame.

An object of the invention is to provide a new and improved automatic-feed grinder which is of a compact construction having a relatively simple drive for counter-rotating augers in a hopper and a feed screw in a grinding head to provide for reverse flow of the meat in a rearward direction in the hopper and a forward direction in the grinding head, with a relatively simple drive for the augers and the feed screw and with the components being mounted upon a supporting frame for ready disassembly without the use of special tools for cleaning thereof.

Another object of the invention is to provide an automatic feed grinder having counter-rotating augers in a hopper superimposed on a grinding head having a feed screw, with the counter-rotating augers feeding meat to the rear of the hopper and forcing the meat into the grinding head for advance of the meat in the grinding head by means of a feed screw which forces the meat through grinding elements at the front end of the grinding head whereby the front-to-rear dimensions of the automatic-feed grinder are reduced to a minimum.

Still another object of the invention is to provide an automatic-feed grinder as defined in the preceding paragraph wherein the counter-rotating augers and feed screw are driven by a common drive means positioned to the rear of the hopper and grinding-head and with releasable drive connections for the counter-rotating augers disposed generally above a releasable drive connection for the feed screw and with these drive connections being separable by axial movement of the augers and the feed screw.

Still another object of the invention is to provide an automatic feed grinder as defined in the preceding paragraph wherein the hopper is mounted on a supporting frame for pivotal movement between an operative position engaging the top of the grinding head, and a disassembled cleaning position, with the bottom thereof remote from the grinding head as well as being mounted for front-to-rear movement to achieve the axial movement of the augers for separation of the drive connections thereof to the drive means.

A further object of the invention is to provide an automatic-feed grinder for meat or the like comprising: a frame; grinding means including a grinding head supported by said frame and having a cylindrical cavity with a top opening at one end thereof; grinding elements at an end of said cavity remote from said top opening, and a feed screw in said cavity for feeding meat from said top opening and forcing the meat through said grinding elements; means for supplying meat to said top opening including a hopper mounted on said frame in a position overlying said grinding head and having walls including a front wall, a rear wall and a bottom wall, a discharge opening in said bottom wall and adjacent the rear wall which communicates with said top opening of the grinding head in sealed relation thereto, and a pair of counter-rotating augers in said hopper adjacent the bottom wall parallel to and above said feed screw and extending between said front and rear walls of the hopper for forcing meat in the hopper rearwardly toward the rear wall of the hopper and into the grinding head cavity by flow through said discharge opening of the hopper and the top opening of the grinding head followed by forward flow of the meat through the grinding head.

An additional object of the invention is to provide an automatic-feed grinder comprising: a frame; a grinding head on the frame; said grinding head having a cavity; a top opening at the rear end of the cavity and grinding elements at the front end of the cavity; a hopper mounted on the frame and having a front-to-rear dimension to substantially overlie the grinding head and having a discharge opening at the rear thereof communicating with the top opening of the grinding head; and means in the hopper extending horizontally along the bottom thereof for moving meat therein toward the rear of the hopper and into said cavity.

Still another object of the invention is to provide an automatic-feed grinder comprising, a frame, drive means mounted at the rear of the frame, a hopper on said frame having front, rear and bottom walls and a bottom outlet at the rear thereof, a pair of horizontally-disposed counter-rotating augers within the hopper adjacent the bottom thereof for feeding meat to and through said bottom outlet, removable means on the hopper front wall rotatably supporting one end of the augers, drive shafts extending from the drive means through the rear wall of the hopper, drive connections between the other ends of the augers and the drive shafts constructed to permit separation thereof by axial movement of the augers, a grinding head beneath the hopper for receiving meat fed through the bottom outlet of the hopper, and means mounting the hopper on the frame for movement away from the drive means to achieve axial movement of the augers to separate said drive connections, and means mounting the hopper for pivotal movement about an axis lying outside the hopper for movement to a cleaning position and which permits access to the grinding head for cleaning thereof.

An additional object of the invention is to provide a method of grinding meat with automatic feeding thereof wherein a hopper for storage of meat in bulk is located above a grinding head having a cavity with grinding elements at an end of the cavity comprising the steps of, feeding meat in the hopper in a horizontal rearward direction to a discharge opening at the rear of the hopper which aligns with a top opening at an end of the cavity remote from the grinding elements, forcing meat under pressure from the hopper into said cavity by flow through said discharge opening and top opening, and advancing meat along said cavity in a forward direction opposite to the meat flow in the hopper for passage through said grinding elements while exerting pressure on the meat in the cavity including pressure exerted on meat entering the cavity.

BRIEF DESCRIPTION OF THE DRAWINGS

FIG. 3 is a vertical section, on an enlarged scale, taken generally along the line 3—3 in FIG. 1;

FIG. 4 is a vertical section taken generally along the line 4—4 in FIG. 3;

DESCRIPTION OF THE PREFERRED EMBODIMENT

Figure 1:
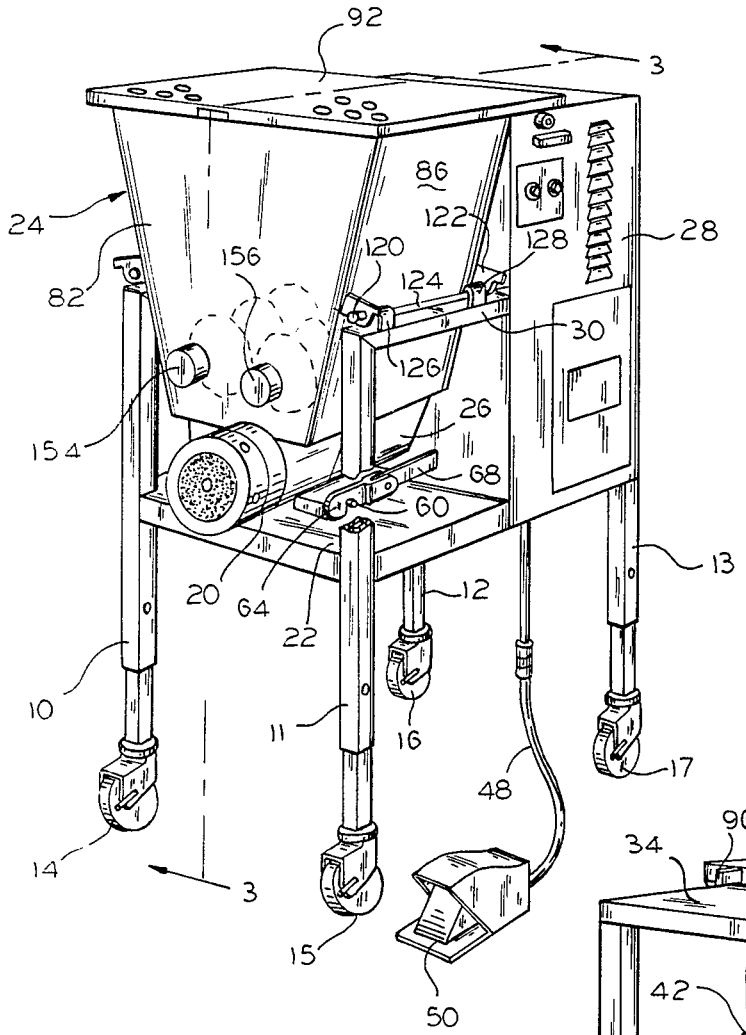
FIG. 1 is a perspective elevational view of the automatic-feed grinder, looking generally toward the front thereof and with a support leg broken away.
Figure 2:
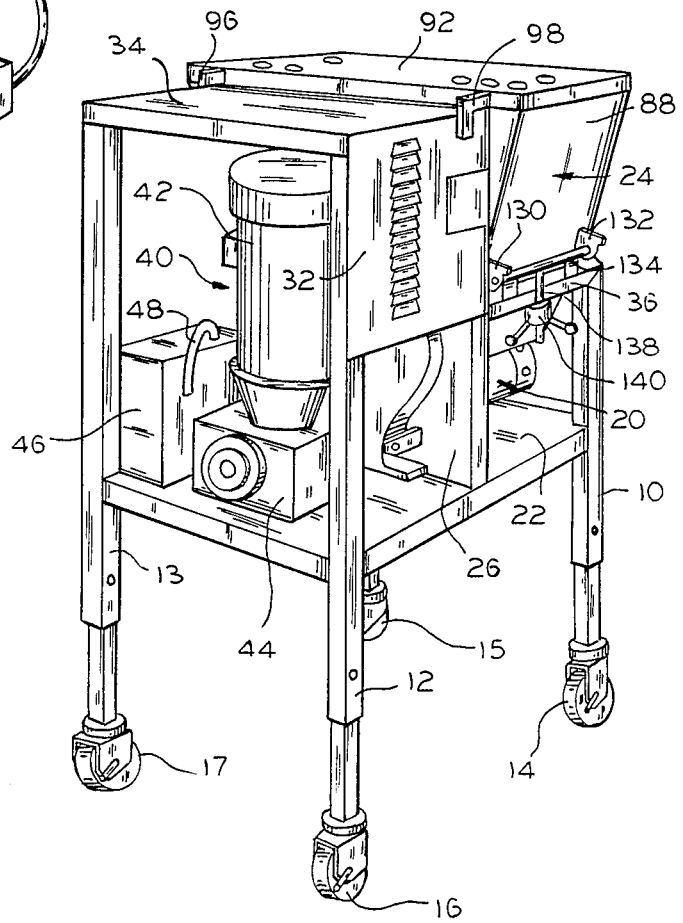
FIG. 2 is a view generally similar to FIG. 1, looking generally at the rear of the automatic-feed grinder.
Figure 8:
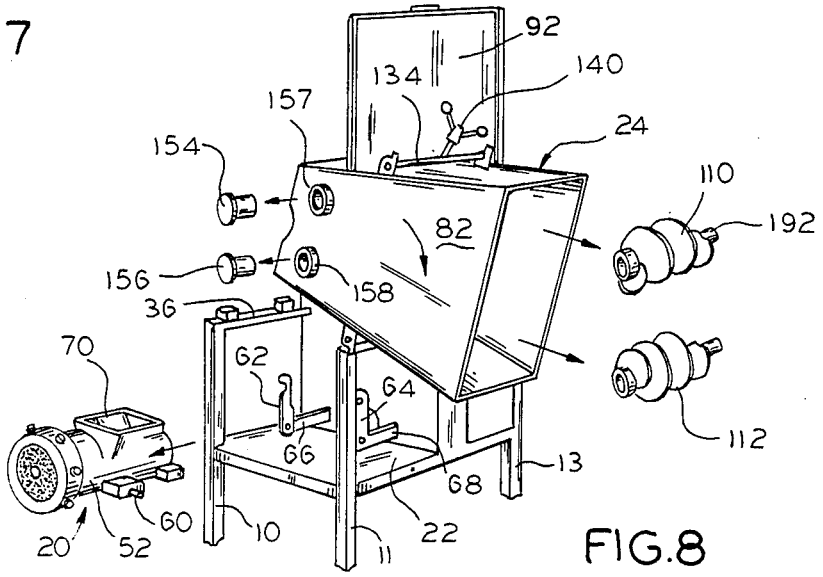
FIG. 8 is a perspective exploded view of the automatic-feed grinder showing the disassembled components thereof and the hopper in cleaning position.

The automatic-feed grinder is generally shown in the perspective views of FIGS. 1, 2 and 8. A frame has adjustable-height front legs 10,11 and rear legs 12,13, each of which has a lockable floor-engaging wheel 14, 15, 16 and 17 which enable free movement of the automatic-feed grinder to a desired position and retention thereof at that position. The frame supports a grinding head, indicated generally at 20, on a panel 22 and a hopper, indicated generally at 24, superimposed on the grinding head. The frame has an intermediate, vertical panel 26 which coacts with the rear leg 13 of the frame to mount a panel 28 having controls and a horizontal frame member 30 extends between the upper end of the front leg 11 and the leg 13. The intermediate panel 26 also coacts with the rear leg 12 for attachment of a panel 32 with the panels 28 and 32 being spanned by a top panel 34. A frame member 36 extends between the leg 12 and the top of the front leg 10.

A drive means, indicated generally at 40, is mounted on a gearbox 170, described hereinafter. The drive means includes a motor 42 and a gear reduction unit 44 which will be more particularly described hereinafter. A control box 46 for the motor has a cable 48 extending to a foot pedal 50 which, in a conventional manner, can provide an on-off control for the motor 42.

The grinding head 20 is shaped as an elongate, generally cylindrical member 52, with integral external sections 54 and 56, each having a flat surface for support of the grinding head on the panel 22. The section 54 is mounted intermediate the ends of the grinding head and has a pair of outwardly-extending pins 58 and 60 (FIG. 4) at the opposite ends thereof for coaction with clamp structure. This clamp structure comprises a pair of grinding head clamping bars 62 and 64 (FIG. 8) which are pivotally-mounted to forwardly-extending support bars 66 and 68, secured at their rear ends to the gearbox 170. As seen in FIG. 1, the clamping bar 64 has a notch therein in engagement with the pin 60 formed on the section 54 of the grinding head, and, as seen in broken line in FIG. 3, the clamping bar 62 has a notch in interengaging relation with the pin 58. These clamping bars are movable between a grinding head release position, as shown in FIG. 8, and a position in which the grinding head is retained against movement in a front-to-rear direction, as seen in FIGS. 1 and 3. These clamping bars do not retain the grinding head against vertical movement, with this function being performed by the hopper 24 in a manner to be described.

The grinding head has a top opening 70 at the rear thereof whereby meat entering the top opening flows to an internal cavity which has a rotatable feed screw 72 with a spiral flight 74 which varies in pitch, in a conventional manner, to advance the meat forwardly within the cavity to grinding elements at the front end of the cavity. These grinding elements include a fixed perforate grinding plate 76 and a knife 78. The knife 78 is releasably mounted on an end of the feed screw by having a square opening fitted onto a square section of the feed screw shaft. The grinding plate 76 has a central opening to receive a rounded end of the feed screw shaft. The grinding plate 76 is retained in position on the grindings head by a retaining ring 80 threaded onto an end of the grinding head and the grinding plate retains the knife 78 in association with the feed screw.

The hopper 24 has a front wall 82, a rear wall 84, and a pair of downwardly-sloped side walls 86 and 88 and a bottom wall 90. A cover 92 for the hopper is pivotally-mounted to the underside of the top panel 34 by means of an elongate pivot rod 94 connected to brackets 96 and 98 extending rearwardly from the cover 92 and with the pivot rod 94 being mounted in a pair of friction blocks adjacent each end thereof, with one pair of friction blocks being shown at 100 in FIG. 3 and which are fastened to the underside of the panel 34.

The hopper bottom wall 90 has approximately half its length shaped as seen particularly in FIGS. 3 and 4 for coaction with a pair of self-feeding counter-rotating augers 110 and 112 positioned in the bottom of the hopper and which will be more particularly described hereinafter. As seen in FIG. 4, this portion of the bottom wall has a pair of curved sections **90*a* and 90*b* which fairly closely conform to the curvature of the counter-rotating augers 110 and 112, respectively. Substantially the entire remainder of the bottom wall 90 is provided with a bottom outlet discharge opening 114 (FIGS. 3 and 5) which extends from the bottom wall sections 90*a* and 90*b* to a location adjacent the rear wall 84 of the hopper and which communicates with the top opening 70 of the grinding head 20. This portion of the bottom wall as well as parts of sections 90*a* and 90*b* thereof and the hopper front wall 82 engage against surfaces of the grinding head whereby the hopper holds the grinding head against movement away from the panel 22**.

Figure 5:
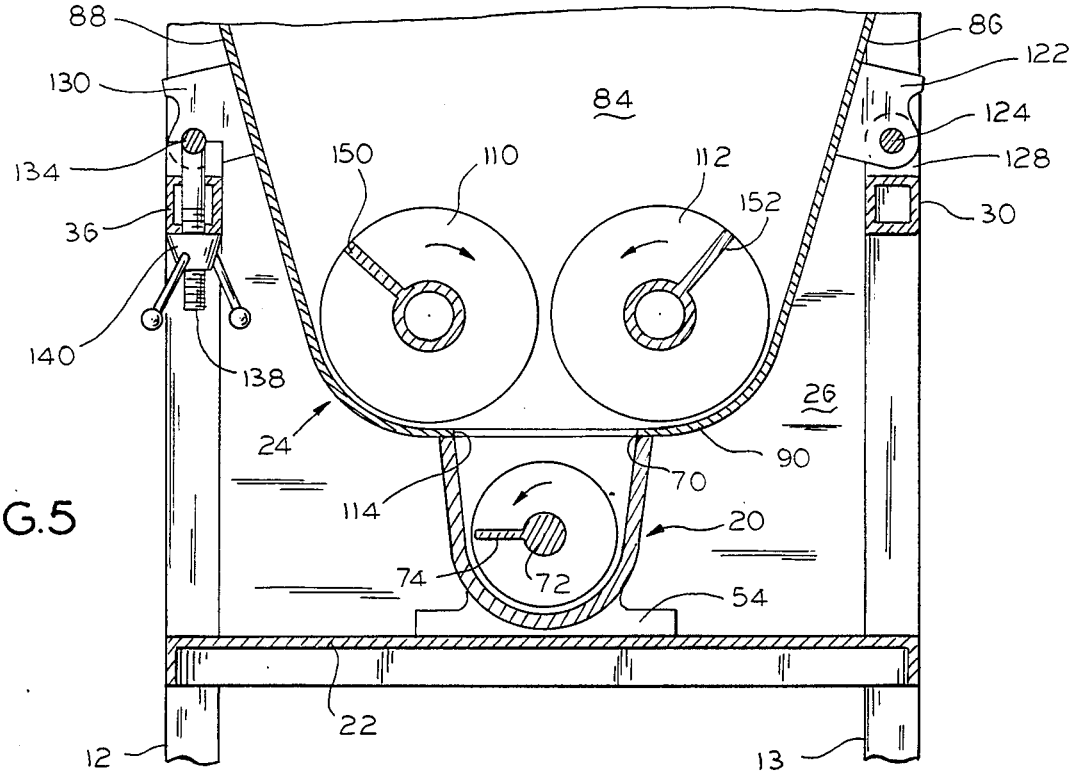
FIG. 5 is a vertical section taken generally along the line 5—5 in FIG. 3.
Figure 7:
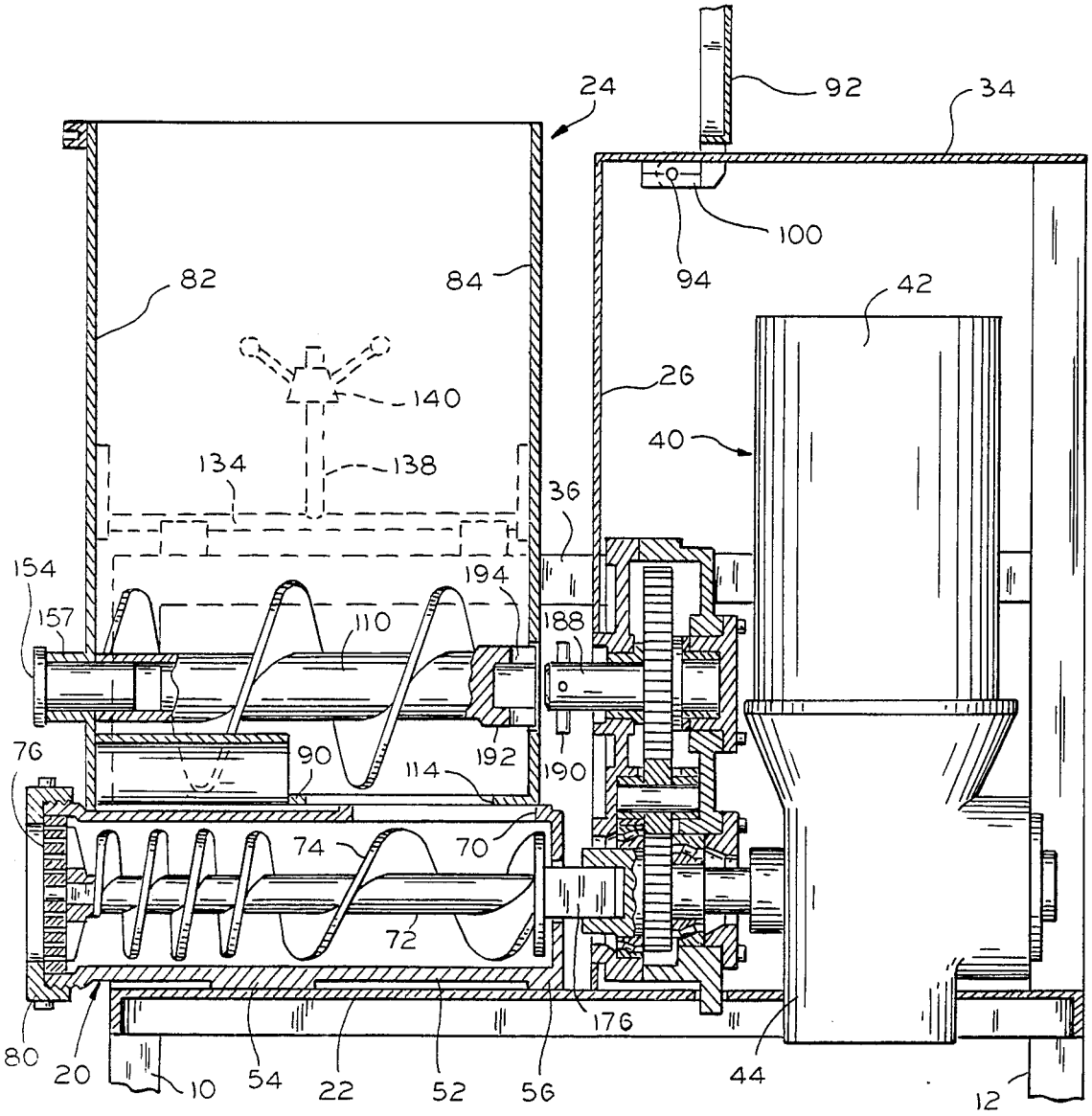
FIG. 7 is a view similar to FIG. 3 showing the position of the hopper in a partially-disassembled position.

The hopper 24 is mounted for compound movement, including movement in a front-to-rear direction, as well as pivotal movement about an axis outside the body of the hopper. These movements are achieved by a mounting associated with the horizontal frame member 30 and which is seen in FIGS. 1 and 5. A pair of hinge members 120 and 122 extend outwardly from the hopper side wall 86 and mount a pivot rod 124 therebetween which is rotatably mounted in a pair of hinge blocks 126 and 128 fixed to and extending upwardly from the horizontal frame member 30. The pivot rod 124 has a length between its connections to the hinge members 120 and 122 greater than the distance between the remote faces of the hinge blocks 126 and 128 whereby the hopper and pivot rod can move in a front-to-rear direction between the operative position, shown in FIG. 3, and the partially disassembled position, shown in FIG. 7. Additionally, the pivot rod and associated structure provides for pivoting of the hopper 24 to the cleaning position, shown in FIG. 8, which also removes the hopper from associated relation with the grinding head 20.

A hopper clamp firmly holds the hopper in the operative position, shown in FIGS. 1, 2 and 3 and this structure is seen in FIGS. 2, 3, 5, 7 and 8. A pair of hinged members 130 and 132 extending outwardly from the hopper side wall 88 pivotally mount a pivot bar 134 having a threaded rod 138 extending therefrom intermediate its ends, which rotatably mounts a hopper lock 140 which can be rotatably drawn against the underside of the horizontal frame member 36, as seen in FIGS. 2, 3 and 5, to hold the hopper down against the upper side of the grinding head 20.

The self-feeding counter-rotating augers 110 and 112 rotate in the directions shown by the arrows in FIG. 5 and extend from front to rear of the hopper for feeding of meat through the bottom discharge opening 114 into the cavity of the grinding head 20 through the top opening 70 thereof. Each of these augers has respective flights 150 and 152 with a pitch to capture meat therebetween and advance it toward the rear wall 84 of the hopper and with each of the flights arranged at an angle to coact with the rear wall 84 of the hopper and force the meat downwardly through the bottom outlet discharge opening 114. This angle is approximately 36° . The capture of meat at the front of the hopper is facilitated by the bottom wall curved sections **90*a* and 90*b***.

The forward ends of the counter-rotating augers 110 and 112 are rotatably supported by the front wall 82 of the hopper by means of a pair of plastic bushings 154 and 156 which fit within a pair of tubular members 157 and 158 extending forwardly from the front wall 82 of the hopper and which have bayonet slots for coaction with a pin on each of the bushings 154 and 156 whereby the bushings may be inserted into the tubular members and then rotated for locking thereto. Each of the augers has a hollow forward end whereby the plastic bushing 154 can fit therein to rotationally-mount the forward end of the auger. The rear ends of the augers are rotatably supported by separable and releasable drive connections to the drive means 40.

Figure 6:
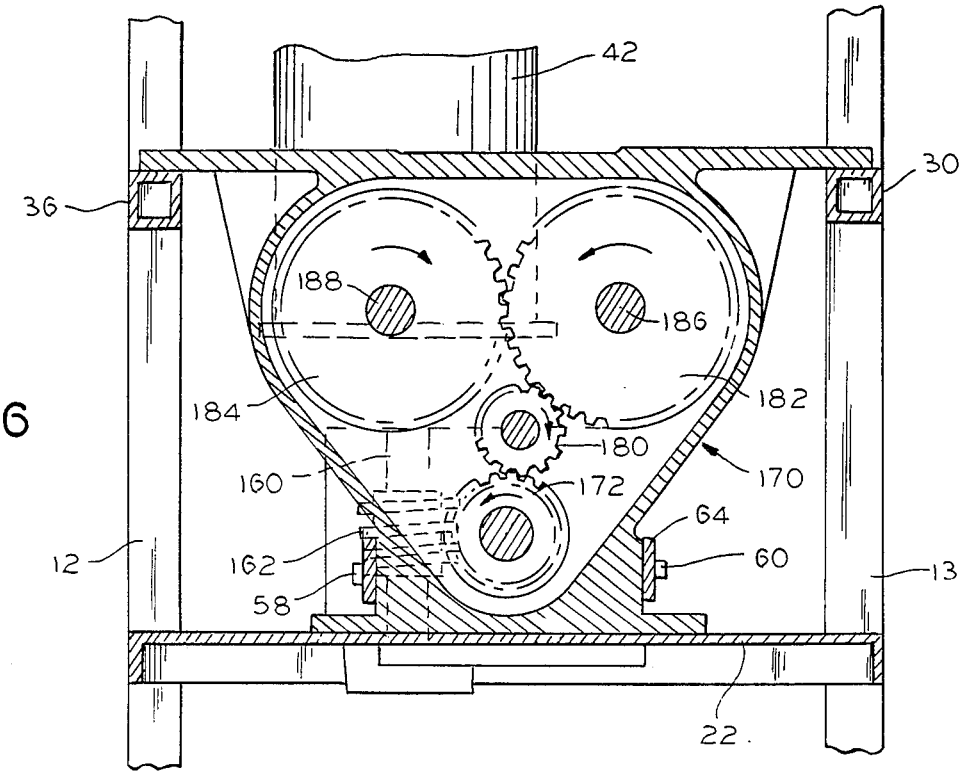
FIG. 6 is a vertical section taken generally along the line 6—6 in FIG. 3.

The drive means 40 has the motor 42 and gear reduction unit 44, previously described. As seen in FIGS. 3 and 6, the motor drives a downwardly-extending shaft 160 having a worm 162 engaging a worm wheel 164 on a rotatable sleeve rotatably supported by bearings, one of which is shown at 166. The rotatable sleeve is internally keyed to a shaft 168 which extends into a gearbox, indicated generally at 170, and which rotatably mounts a gear 172 by bearings and which has a tubular forward extension 174 with a square opening which receives a square end 176 of the feed screw 72. The gear 172 meshes with a rotatable idler gear 180 (FIGS. 3 and 6) which meshes with an auger drive gear 182 and with the auger drive gear 182 meshing with an auger drive gear 184. Each of the auger drive gears 182 and 184 has a drive shaft 186 and 188, respectively, extending forwardly therefrom and through openings in the rear wall 84 of the hopper 24 when the hopper is in operative position, as seen in FIG. 3. Each of the drive shafts 186 and 188 has a transversely-extending pin. The pin 190 is shown in association with the drive shaft 188 and makes a releasable and separable connection with the rear end of the auger 110. The tubular rear ends of the augers, as shown at 192 for the auger 110 in FIG. 7, each have a recess to receive the drive shafts 186 and 188 and a bayonet-type slot 194 to receive the pin 190. The drive connection is releasable by relative rotation between the auger and the drive shaft and separable by axial movement of the auger.

With the structure of the automatic-feed grinder in operative position, as seen in FIGS. 1, 2 and 3, the grinding head 20 is held in operative position by means of the clamping bars 62 and 64 and by the hopper 24 engaging the upper side thereof and with the hopper being held in position by the hopper clamp 140. The feed screw 72 of the grinding head and the counter-rotating augers 110 and 112 have releasable drive connections to the drive means, with the drive connections being located at the rear of the hopper and the grinding head and being in a generally vertical relation with the drive shafts 186 and 188 for the augers being located above the drive connection to the feed screw 72. Operation of the motor 42 causes the counter-rotating augers to self-feed meat rearwardly of the hopper for discharge thereof through the discharge opening 114 into the grinding head.

The angle of the auger flights coacting with a rear wall of the hopper forces the meat into the cavity of the grinding head and exerts pressure which is transmitted and added to the pressure of the feed screw pressing the meat through the grinding plate 76. The counter-rotating augers have their flights providing a force vector to force the meat downwardly into the grinding head. The gears of the gearbox are related to have the feed screw 72 rotate at a rate twice the rotation of the counter-rotating augers; however, the larger dimensions of the augers assure an overfeed of meat to the grinding head. In considering the flow of meat in the hopper and through the grinding head, it will be noted that there is reverse flow with the flow in the hopper being rearwardly, and the flow in the high grinding head being forwardly, which achieves a compact construction, with the hopper superimposed on the grinding head, rather than having the grinding head extending forwardly from the hopper as in conventional meat grinders.

When the automatic feed grinder is to be cleaned, the structure provides for disassembly for cleaning, without the use of special tools. One possible sequence of disassembly is to remove the retaining ring 80 on the grinding head and then axially withdraw the grinding plate 76 and the knife. The feed screw 72 is also axially withdrawn, as permitted by the separable connection between the square end 176 of the feed screw and the square opening 174 of the tubular member associated with the gear 172. The hopper clamp, including the hopper lock 140, is then released from engagement with the frame member 36 and pivoted to a position as seen in FIG. 8. The bushings 154 and 156 are removed from the tubular members 157 and 158 at the front of the hopper wall 82, which frees the front ends of the augers 110 and 112 from their support by the hopper front wall 82. The augers can then be rotated a small amount to release their drive connections with the pins 190 on the drive shafts 186 and 188 and the hopper can then be pulled forwardly to the position shown in FIG. 7. The augers 110 and 112 are adjacent the bottom wall 90 of the hopper and are supported thereby when the hopper is moved forwardly and the tubular rear ends of the augers are moved off the drive shafts 186 and 188. Thereafter, the augers can be lifted out of the hopper, followed by pivoting movement of the hopper 24 to the position shown in FIG. 8, which permits easy access to the interior of the hopper for cleaning thereof and which frees the grinding head 20 for removal after release of the clamping bars 62 and 64. After cleaning, the parts can be reassembled by reversing the previously-described sequence of operations. Alternatively, it will be evident that the components of the grinding head can be removed after removal of the grinding head from the frame, as seen in FIG. 8.

The disclosure also relates to a new and improved method of grinding meat with automatic feeding thereof. In this method, there is a hopper for storage of meat in bulk, which is located above a grinding head having a cavity with grinding elements at an end of the cavity and with the method comprising the steps of, feeding meat in the hopper in a horizontal rearward direction to a discharge opening at the rear of the hopper which aligns with the top opening at an end of the cavity remote from the grinding element; forcing meat under pressure from the hopper into the cavity by flow through said discharge opening and top opening; and advancing meat along said cavity in a forward direction opposite to the meat flow in the hopper for passage through said grinding head elements while exerting pressure on the meat in the cavity, including pressure exerted on meat entering the cavity. The feeding of the meat in the hopper by the self-feeding counter-rotating augers provides a reaction with the rear wall of the hopper to exert downward pressure on the meat which is transmitted through the meat advancing to the grinding plate of the grinding head along with pressure exerted by the feed screw thereof. This method avoids the use of any tunnel or other structure in the hopper and associated with the counter-rotating augers to create a pressure chamber and, thus, avoids the complications of such a construction and resulting difficulty of cleaning thereof.

I claim:

1. An automatic-feed grinder comprising: a frame; a grinding head on the frame; said grinding head being defined by a generally cylindrical member having a cavity and front and rear walls; a top opening in said member adjacent the rear wall thereof and grinding elements adjacent the front wall thereof; a hopper mounted on the frame and having a front wall, a rear wall and a bottom wall and a discharge opening in said bottom wall adjacent the hopper rear wall communicating with said top opening; the rear wall of the hopper and the rear wall of the generally cylindrical member being generally coplanar and the front-to-rear dimensions of the hopper and grinding head being substantially equal whereby the hopper and grinding head are in superimposed relation; and means in the hopper extending horizontally along the bottom thereof for moving meat therein toward the hopper rear wall and through said discharge opening and top opening into said cavity.

2. An automatic-feed grinder as defined in claim 1 wherein said means in the hopper for moving meat comprises a pair of augers, a feed screw in said grinding head cavity, and drive means for said augers and feed screw positioned at the rear of the hopper and grinding head and having drive connections to said augers and feed screw with the auger drive connections directly above the drive connection to said feed screw.

3. An automatic-feed grinder for meat comprising a frame; grinding means including a grinding head supported by said frame and having a cylindrical cavity with a top opening at one end thereof; grinding elements at an end of said cavity remote from said top opening, and a feed screw in said cavity for feeding meat from said top opening and forcing the meat through said grinding elements; means for supplying meat to said top opening including a hopper mounted on said frame in a position overlying said grinding head and having walls including a front wall, a rear wall and a bottom wall, a discharge opening in said bottom wall and adjacent the rear wall which communicates with said top opening of the grinding head in sealed relation thereto, and a pair of counter-rotating augers in said hopper adjacent the bottom wall parallel to and above said feed screw and extending between said front and rear walls of the hopper for forcing meat in the hopper rearwardly toward the rear wall of the hopper and into the grinding head cavity by flow through said discharge opening of the hopper and the top opening of the grinding head followed by forward flow of the meat through the grinding head.

4. An automatic-feed grinder as defined in claim 3 including drive means on said frame for driving said feed screw and said pair of augers and releasable drive connections therebetween.

5. An automatic-feed grinder as defined in claim 4 wherein said grinding head is removably mounted on said frame, and means mounting said hopper for movement to a position remote from the grinding head for access to the grinding head.

6. An automatic-feed grinder as defined in claim 4 wherein said hopper-mounting means includes means mounting the hopper for movement away from said drive means and also for pivoting the hopper about an axis parallel to said augers to a position substantially above said grinding head.

7. An automatic-feed grinder as defined in claim 6 wherein said releasable drive connections include a pin and slot connection between the augers and the drive means which can be released by rotation of the augers relative to the drive means.

8. An automatic-feed grinder as defined in claim 3 including means mounting the hopper for upward pivotal movement away from the grinding head, and manually-releasable means for holding the hopper in association with the grinding head.

9. An automatic-feed grinder as defined in claim 8 including drive means for the augers behind the rear wall of the hopper and with drive shafts extending through the rear wall into the hopper, releasable drive connections between the augers and the drive shafts and located in the hopper, and means mounting the hopper for horizontal movement away from the drive means.

10. An automatic-feed grinder comprising: a frame; a grinding head on the frame; said grinding head having a cavity; a top opening at the rear end of the cavity and grinding elements at the front end of the cavity; a hopper mounted on the frame and having a front-to-rear dimension to substantially overlie the grinding head and having a discharge opening at the rear thereof communicating with the top opening at the rear end of the cavity; means in the hopper extending horizontally along the bottom thereof for moving meat therein toward the rear of the hopper and into said cavity, said hopper having a plurality of walls including a front wall, a rear wall and a bottom wall with said discharge opening being in the bottom wall and adjacent the rear wall, said meat-moving means comprising a pair of augers in said hopper adjacent the bottom wall and operable to advance meat rearwardly of the hopper toward said discharge opening, auger drive means at the rear of the hopper including drive shafts extending into the hopper through the rear wall thereof, means mounting the hopper on the frame for movement away from the drive means to separate the augers from the drive shafts, and means mounting the hopper for additional movement on the frame to a position removed from the grinding head to permit access to the grinding head.

11. An automatic-feed grinder as defined in claim 10 including releasable clamps for holding the grinding head on the frame.

12. An automatic-feed grinder as defined in claim 10 including removable bearings in the front wall of the hopper for rotatably mounting an end of the augers remote from the ends thereof associated with the drive shafts.

13. An automatic feed grinder comprising: a frame; a grinding head on the frame; said grinding head having a cavity; a top opening at the rear end of the cavity and grinding elements at the front end of the cavity; a hopper mounted on the frame and having a front-to-rear dimension to substantially overlie the grinding head and having a discharge opening at the rear thereof communicating with the top opening at the rear end of the cavity; means in the hopper extending horizontally along the bottom thereof for moving meat therein toward the rear of the hopper and into said cavity comprising, a pair of augers, a feed screw in said grinding head cavity, and drive means for said augers and feed screw positioned at the rear of the hopper and grinding head and having drive connections to said augers and feed screw with the auger drive connections directly above the drive connection to said feed screw and said drive connections being releasable.

14. An automatic-feed grinder comprising, a frame, drive means mounted at the rear of the frame, a hopper on said frame having front, rear and bottom walls and a bottom outlet at the rear of the hopper, a pair of horizontally-disposed counter-rotating augers within the hopper adjacent the bottom thereof for feeding meat to and through said bottom outlet, removable means on the hopper front wall rotatably supporting one end of each of the augers, drive shafts extending from the drive means through the rear wall of the hopper, drive connections between the other ends of the augers and the drive shafts constructed to permit separation thereof by axial movement of the augers, a grinding head beneath the hopper for receiving meat fed through the bottom outlet of the hopper, and means mounting the hopper on the frame for movement away from the drive means to achieve axial movement of the augers to separate said drive connections, and means mounting the hopper for pivotal movement about an axis lying outside the hopper for movement to a cleaning position and which permits access to the grinding head for cleaning thereof.

15. An automatic-feed grinder as defined in claim 14 wherein said grinding head has a feed screw and a drive connection between said feed screw and drive means located below said drive shafts.

16. An automatic-feed grinder as defined in claim 14 wherein said grinding head is removably mounted on said frame and said hopper bottom wall engages the top of said grinding head.

17. An automatic-feed grinder as defined in claim 16 wherein said grinding head has an internal cavity with a top opening at the rear communicating with the hopper bottom outlet.

18. An automatic-feed grinder as defined in claim 16 including clamping bars on the frame engageable with the grinding head, and a clamp coacting with the hopper and the frame to hold the hopper on the grinding head.

19. An automatic-feed grinder as defined in claim 14 wherein said counter-rotating augers each have a flight arranged at an angle to coact with the rear wall of the hopper and force the meat downwardly through said bottom outlet.

20. An automatic-feed grinder as defined in claim 19 wherein said angle is approximately 36°.

* * * * *